US006455156B2

(12) United States Patent
Tanaka et al.

(10) Patent No.: US 6,455,156 B2
(45) Date of Patent: Sep. 24, 2002

(54) HOLLOW FIBERS AND MANUFACTURING METHOD OF HOLLOW FIBERS

(75) Inventors: Kazuhiko Tanaka; Hitoshi Nakatsuka; Nobuhiro Koga; Masao Kawamoto; Akihiro Hokimoto; Tateki Yamakawa; Ichirou Inoue; Kiyoshi Hirakawa, all of Okayama-Pref. (JP)

(73) Assignee: Kuraray Co., Ltd., Kurashiki (JP)

( * ) Notice: Subject to any disclaimer, the term of this patent is extended or adjusted under 35 U.S.C. 154(b) by 97 days.

(21) Appl. No.: 09/809,200

(22) Filed: Mar. 16, 2001

(30) Foreign Application Priority Data

Mar. 16, 2000 (JP) ..... 2000-073755
Nov. 22, 2000 (JP) ..... 2000-355502

(51) Int. Cl.[7] ..... D01F 6/00
(52) U.S. Cl. ..... 428/398; 428/376; 428/373
(58) Field of Search ..... 428/373, 398, 428/393, 370, 376

(56) References Cited

U.S. PATENT DOCUMENTS 5,997,980 A * 12/1999 Matoba et al. ..... 428/376
6,048,615 A * 4/2000 Liu ..... 428/397

FOREIGN PATENT DOCUMENTS

JP 7-316977 12/1995

* cited by examiner

*Primary Examiner*—N. Edwards
(74) *Attorney, Agent, or Firm*—Oblon, Spivak, McClelland, Maier & Neustadt, P.C.

(57) ABSTRACT

The present invention provides a hollow fiber, which includes:

at least one thermoplastic polymer with an equilibrium water content of 2% or less;

wherein the number of hollow portions ($\alpha_1$) and a hollow ratio ($\alpha_2$) in said fiber satisfy the following equations:

$$\alpha_1 \geqq 7$$

$$2 \leqq \alpha_2 \leqq 65$$

$$0.14 \leqq (\alpha_1 \times \alpha_2)/100 \leqq 250.$$

Other embodiments of the present invention include articles containing the hollow fiber, methods of making and of using, and a sea-island conjugate fiber

12 Claims, 1 Drawing Sheet

HOLLOW FIBERS AND MANUFACTURING METHOD OF HOLLOW FIBERS

BACKGROUND OF THE INVENTION

1. Field of the Invention

This invention relates to hollow fibers which are light, and which have a favorable hand with both a dry and bulky feel, as well as a manufacturing method thereof. In particular, the present invention relates to porous hollow fibers having a preferable cross section like a lotus root, and a fiber structure thereof.

2. Discussion of the Background

Synthetic fibers such as polyester and polyamide are generally used in clothing as well as industrial applications because of their excellent physical and chemical properties, and are industrially and commercially valuable. However, compared with natural fibers such as silk, cotton and linen, synthetic fibers have monotonous hand or gloss, because of a simple distribution of yarn fineness, large yarn fineness and simple transverse cross sectional shape. Furthermore, synthetic fibers are typically low in quality and have a cold and slimy feel. In order to improve the above-described synthetic fibers and address these drawbacks, a profiled transverse cross sectional shape synthetic fibers is adopted, or the structure of the fibers is made hollow.

Typically, however, fibers having a profiled cross section, or hollow fibers manufactured by using profiled or hollow spinning nozzles are problematic in that the profiled cross section is lost, or the hollow portions tend to collapse either by the surface tension of the resin in a molten state from spinning to solidification or by the take-up tension during spinning. In particular, when developing a porous hollow shape, even when the fibers have a porous hollow structure just after spinning, the porous hollow portion collapses and is eliminated or the proportion of the hollow portion tends to decrease, so that it has been substantially impossible to obtain fibers with porous hollow portions by the above methods.

Japanese Published Unexamined Patent Application No. Hei 7-316977 proposes a technique of forming conjugate fibers using an alkali-decomposable polymer as an island component and an alkali-resistant polymer with water absorption rate of 3% or more, such as polyamide or ethylene vinyl alcohol type copolymer as a sea component, and removing the decomposable polymer with a hot aqueous alkali solution to obtain porous hollow fibers. This technique undesirably requires a difficult treatment of the waste water that contains the alkali-decomposed products and leaves significant environmental problems. In addition, since it is necessary to extract the island component with aqueous alkali solution through the sea component of the conjugate fibers, the method restricts the type of the polymer in that a water absorbing polymer must be used for the sea component. It is difficult to use a polylactic acid or polyester sensitive to alkalis for the sea component, and it is substantially impossible to produce porous hollow fibers wherein the sea component includes polyesters mainly composed of polylactic acid, polyethylene terephthalate or polybutylene terephthalate as the skeleton.

SUMMARY OF THE INVENTION

It is an object of the present invention to solve the foregoing problems associated with the conventional fibers.

It is another object of the present invention to provide hollow fibers constituted with a so-called hydrophobic polymer scarcely showing water absorption.

It is another object of the present invention to provide hollow fibers having a porous hollow portion excellent in lightness, dry and bulky feels, as well as a fiber structure containing them.

It is another object of the present invention to provide conjugate fibers suitable for the manufacture of hollow fibers without waste water treatment problems or environmental problems.

This invention further intends to provide a method of manufacturing hollow fibers using such conjugate fibers.

These and other objects may be accomplished with the present invention, the first embodiment of which provides a hollow fiber, which includes:

at least one thermoplastic polymer with an equilibrium water content of 2% or less;

wherein the number of hollow portions ($\alpha_1$) and a hollow ratio ($\alpha_2$) in said fiber satisfy the following equations:

$$\alpha_1 \geqq 7$$

$$2 \leqq \alpha_2 \leqq 65$$

$$0.14 \leqq (\alpha_1 \times \alpha_2)/100 \leqq 250.$$

Another embodiment of the present invention provides a fiber structure, which includes the hollow fiber as described above.

Another embodiment of the present invention provides an article selected from the group including multi-filament yarn, spun yarn, woven fabric, knitted fabric, non-woven fabric, paper, artificial leather, fiberfill, textured yarn, blended filament yarn, blended spun yarn, twisted yarn, entangled yarn, crimped yarn, union woven fabric, union knitted fabric, fiber laminate, natural fiber laminate, semi-synthetic fiber laminate, synthetic fiber laminate, clothing, living material, industrial material, medical articles, and combinations thereof, which includes the hollow fiber as described above.

Another embodiment of the present invention provides a method for making hollow fibers, which includes:

treating with water at least one sea-island conjugate fiber that includes:

a sea component that includes at least one thermoplastic polymer with an equilibrium water content of 2% or less; and an island component that includes at least one water soluble thermoplastic polyvinyl alcohol polymer; wherein the number of island components ($\alpha_n$) and the island component ratio ($\alpha_s$) in the conjugate fiber satisfy the following equations:

$$\alpha_n \geqq 7$$

$$2 \leqq \alpha_s \leqq 65$$

$$0.14 \leqq (\alpha_n \times \alpha_s)/100 \leqq 250;$$

and dissolving to remove the water soluble thermoplastic polyvinyl alcohol polymer from the conjugate fiber;

to prepare a hollow fiber.

Another embodiment of the present invention provides a hollow fiber, produced by the process described above.

Another embodiment of the present invention provides a method of treating a fiber structure, which includes:

treating with water a fiber structure that includes at least one sea-island conjugate fiber, wherein the sea-island conjugate fiber includes:

a sea component that includes at least one thermoplastic polymer with an equilibrium water content of 2% or less; and an island component that includes at least one water soluble thermoplastic polyvinyl alcohol polymer; wherein the number of island components ($\alpha_n$) and the island component ratio ($\alpha_s$) in the conjugate fiber satisfy the following equations:

$$\alpha_n \geqq 7$$

$$2 \leqq \alpha_s \leqq 65$$

$$0.14 \leqq (\alpha_n \times \alpha_s)/100 \leqq 250;$$

and dissolving to remove the water soluble thermoplastic polyvinyl alcohol polymer from the conjugate fiber.

Another embodiment of the present invention provides a sea-island conjugate fiber, which includes:

a sea component that includes at least one thermoplastic polymer with an equilibrium water content of 2% or less; and is an island component that includes at least one water soluble thermoplastic polyvinyl alcohol polymer; wherein the number of island components ($\alpha_n$) and the island component ratio ($\alpha_s$) in the conjugate fiber satisfy the following equations:

$$\alpha_n \geqq 7$$

$$2 \leqq \alpha_s \leqq 65$$

$$0.14 \leqq (\alpha_n \times \alpha_s)/100 \leqq 250.$$

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
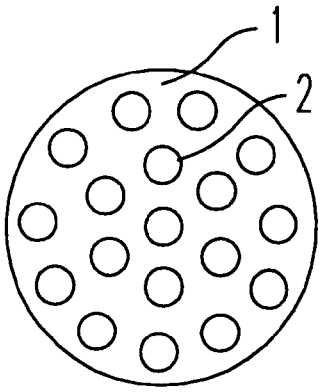
FIG. 1 is a cross sectional view of a fiber illustrating an example of a cross sectional shape of a conjugate fiber according to this invention.

Various other objects, features and attendant advantages of the present invention will be more fully appreciated as the same becomes better understood from the following detailed description of the preferred embodiments of the invention.

Preferably, the fiber structure referred to in this invention includes multi-filament yarns, spun yarns, woven or knitted fabrics, non-woven fabrics, paper, artificial leathers and fiberfill constituted solely of the fibers according to this invention, as well as textured yarns such as blended filament yams or blended spun yarns, twisted yarns, entangled yarns or crimped yarns, union woven fabrics, union knitted fabrics and fiber laminates with natural fibers, semi-synthetic fibers or other synthetic fibers and, in addition, various kinds of final products comprising them such as clothing, living materials, industrial materials and medical articles.

It is important for the hollow fibers according to this invention that the component include a thermoplastic polymer with an equilibrium water content of 2% or less. The number of hollow portions ($\alpha_1$) is 7 or more in the cross section of the fiber and, according to this invention, hollow fibers of high hollow ratio or porous hollow fibers with the number of hollow portions of 9 or more, 30 or more and, particularly preferably, 50 or more can be obtained. These ranges include all values and subranges therebetween, including 8, 9, 10, 11, 12, 13, 14, 15, 16, 17, 18, 19, 20, 70, 200, 500, 700, 1000, and 1200.

Further, it is important in this invention that the number of hollow portions ($\alpha_1$) and the hollow ratio ($\alpha_2$) satisfy the following equations.

$$\alpha_1 \geqq 7$$

$$2 \leqq \alpha_2 \leqq 65$$

$$0.14 \leqq (\alpha_1 \times \alpha_2)/100 \leqq 250$$

There is no particular restriction on the upper limit for the number of hollow portions but forming of conjugate fibers for producing such hollow fibers becomes difficult and the fiber properties tend to be lowered. as the number of hollow portions increases, and they are not suitable for the application uses requiring fiber strength to some extent. Accordingly, the number is desirably set to 1500 or less, more preferably, 1000 or less and, further preferably, 600 or less depending on the application uses. Further, there is no restriction at all for the shape of individual hollow portions, which may be circular, elliptic or any other profiled shape. Further, the hollow portion may be formed continuously or discontinuously in the direction of the fiber axis.

The hollow ratio ($\alpha_2$) of the hollow fiber of this invention is 2 to 65%, preferably, 5 to 60% and, more preferably, 10 to 60%. If the hollow ratio is less than 2%, the effect of lightness and bulky feel as the hollow fiber can not be attained sufficiently and, on the other hand, if the hollow ratio exceeds 65%, it is difficult to provide a follow fiber of practical fiber properties because of insufficiency in the fiber strength or the like. These ranges include all values and subranges therebetween, including 3, 4, 6, 7, 8, 9, 12, 14, 16, 18, 20, 30, 40, and 50.

The number of the hollow portions and the hollow ratio of the hollow fiber can be set properly depending on the application use and it is important that $(\alpha_1 \times \alpha_2)/100$ is set within a range from 0.14 to 250.

If $(\alpha_1 \times \alpha_2)/100$ is less than 0.14, fabrics obtained lack in the feel of lightness.

If $(\alpha_1 \times \alpha_2)/100$ exceeds 250, dense color is less obtained when formed into fabrics.

Accordingly, a range for $(\alpha_1 \times \alpha_2)/100$ is, preferably, from 0.7 to 200 and, more preferably, 1.0 to 150. The above ranges include all values and subranges therebetween, including 0.15, 0.18, 0.19, 0.8, 0.9, 10, 11, 12, 13, 14, 15, 16, 17, 18, 19, 20, 25, 50, 70, 90, 100, 150, 200, and 225.

Thus, a preferred embodiment of the invention provides hollow fibers that contain a thermoplastic polymer with an equilibrium water content of 2% or less in which the number of hollow portions ($\alpha_1$) and the hollow ratio ($\alpha_2$) satisfy the following equation $$\alpha_1 \geqq 7$$

$$2 \leqq \alpha_2 \leqq 65$$

$$0.14 \leqq (\alpha_1 \times \alpha_2)/100 \leqq 250$$

Another preferred embodiment provides a method of manufacturing hollow fibers, or a hollow fiber structure containing the hollow fibers by treating conjugate fibers or a fiber structure containing the fibers which contain a thermoplastic polymer with an equilibrium water content of 2% or less as a sea component and a water soluble thermoplastic polyvinyl alcohol polymer as an island component in which the number of island ($\alpha_n$) and the island component ratio ($\alpha_s$) in the conjugate fiber satisfy the following equation with water, and at least partially dissolving to remove the water soluble thermoplastic polyvinyl alcohol polymer from the conjugate fibers:

$$\alpha_n \geqq 7$$

$$2 \leqq \alpha_s \leqq 65$$

$$0.14 \leqq (\alpha_n \times \alpha_s)/100 \leqq 250$$

A third preferred embodiment provides sea-island type conjugate fibers used for the manufacturing method described above.

The follow fiber of this invention is preferably obtained by removing the island component from the sea-island type conjugate fiber, in which the number of islands ($\alpha_n$) and the ratio of the island component ($\alpha_s$) correspond, respectively, to $\alpha 1$ and $\alpha 2$ described above,. and the technical significance for ($\alpha_n$) and ($\alpha_s$) shown below have the same significance as described above.

$$\alpha_n \geqq 7$$

$$2 \leqq \alpha_s \leqq 65$$

$$0.14 \leqq (\alpha_n \times \alpha_s)/100 \leqq 250$$

Figure 3:
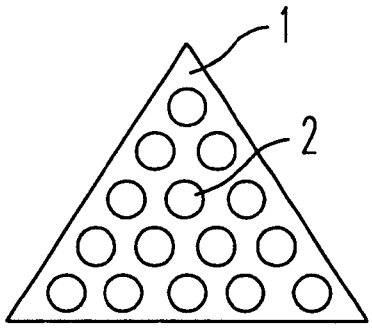
FIG. 3 is a cross sectional view of a fiber illustrating an example of a cross sectional shape of a conjugate fiber according to this invention.
Figure 4:
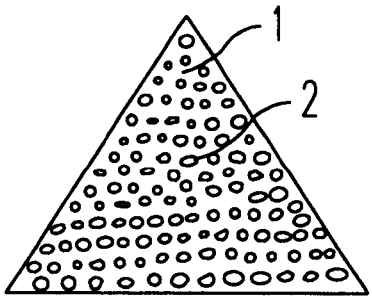
FIG. 4 is a cross sectional view of a fiber illustrating an example of a cross sectional shape of a conjugate fiber according to this invention.

Typical examples of the conjugate fibers used as the raw material for the hollow fiber are shown in the transverse cross sectional views, for example, as in FIG. 1 to FIG. 4. The conjugate fiber in FIG. 1 has a form in which small island components 2 comprising a water soluble thermoplastic polyvinyl alcohol polymer in the fiber cross section are surrounded with a sea component 1 comprising a thermoplastic polymer with 2% or less of equilibrium water content. The conjugate fiber in FIG. 2 has a form in which smaller island components 2 comprising a water soluble thermoplastic polyvinyl alcohol polymer each having an indefinite not circular shape are surrounded with a sea component 1 comprising a thermoplastic polymer with 2% or less of equilibrium water content. FIG. 3 and FIG. 4 show the fiber having a trigonal cross section.

The conjugate ratio between the island component and the sea component of the conjugate fiber can be varied properly depending on the extent of setting the number of hollow portions and the hollow ratio of the finally obtained hollow fiber. If the ratio of the island component is too small, the effect of lightness or the like as the hollow fiber can not be obtained sufficiently and, while on the other hand, if the ratio of the hollow portion is excessive, it is difficult to obtain a hollow fiber having practical fiber properties. Accordingly, the island to sea ratio is set preferably from 2:98 to 65:35 and more preferably from 5:95 to 60:40. These ranges include all values and subranges therebetween, including 3, 4, 7, 10, 12, 14, 18, 22, 26, 35, 45, 55, 60 and 62 for the island (with the complement to 100 for the sea) and 42, 43, 47, 53, 55, 57, 63, 67, 71, 73, 75, 79, 83, 87, and 93 for the sea (with the complement to 100 for the island) portions.

Further, there is no particular restriction on the cross sectional shape of the fiber and it can include, in addition to the circular cross section shown in the drawings, any other shape, for example, flattened shape, elliptic shape, polygonal shape such as from trigonal shape to octagonal shape, T-shape, and multilobal shape such as trilobal to octalobal shape. Further, optional additives such as fluorescence whiteners, stabilizers, flame retardants and colorants may be incorporated as required to the fibers of this invention.

Then, description is to be made for the water soluble thermoplastic polyvinyl alcohol polymer (hereinafter also referred to simply as PVA) as the island component of the conjugate fiber used for producing the hollow fiber according to this invention.

The PVA used in this invention can include homopolymers of polyvinyl alcohol, as well as modified polyvinyl alcohols, for example, introduced with functional groups by copolymerization, terminal modification and post-reaction.

The viscosity average polymerization degree (hereinafter simply referred to as polymerization degree) of PVA used in this invention is preferably 200 to 500, more preferably 230 to 470, and particularly preferably 250 to 450. If the polymerization degree is less than 200, no sufficient stringiness can be obtained upon spinning making it difficult to form fibers depending on the case. If the polymerization degree exceeds 500, the melt-viscosity is exceptionally high making it impossible to discharge the polymer from spinning nozzles depending on the case. By the use of PVA of so-called low polymerization degree having a polymerization degree of 500 or less, the dissolution rate can be increased when the conjugate fiber is dissolved in an aqueous solution and, in addition, shrinkage of the conjugate fiber upon dissolution can be decreased. These ranges include all values and subranges therebetween, including 210, 270, 290, 310, 370, 420, 440 and 480.

The polymerization degree (P) of PVA can be measured according to JIS K6726, the entire contents of which are hereby incorporated by reference. That is, the polymerization degree is determined by saponifying and purifying PVA and then measuring the intrinsic viscosity $\{\eta\}$ (dl/g) measured in water at 30° C. in accordance with the following equation:

$$P = (\{\eta\} \times 10^3/8.29)^{(1/0.62)}$$

When the polymerization degree is within the range as described above, the purpose of this invention can be attained more suitably.

The saponification degree of the PVA used in this invention is, preferably, from 90 to 99.99 mol %, more preferably, 93 to 99.98 mol %, further preferably, 94 to 99.97 mol % and, particularly preferably, 96 to 99.96 mol %. If the saponification degree is less than 90 mol %, the heat stability of PVA is poor and sometimes no satisfactory melt spinning can be attained because of heat decomposition or gelation and, depending on the kind of the copolymerizing monomer to be described later, the water solubility of PVA is lowered. These ranges include all values and subranges therebetween, including 91, 92, 95, 97, 98, and 99%.

On the other hand, PVA with the saponification degree of 99.99 mol % or more tends to lower the solubility and can not be produced stably, so that fibers can not be formed stably.

The PVA used in this invention preferably has a molar fraction, based on vinyl alcohol unit, of a hydroxyl group of vinyl alcohol units located at the center of three successive vinyl alcohol unit chain in terms of triad expression of 70–99.9 mol %, a melting point from 160° C. to 230° C. and alkali metal ions, as sodium ions, of 0.0003 to 1 mass part based on 100 mass parts of PVA.

The hydroxyl group of vinyl alcohol located at the center of three successive vinyl alcohol unit chain in terms of triad expression of the polyvinyl alcohol means peak (I) for PVA reflecting the triad tacticity of the hydroxy group protons measured in a d6-DMSO solution at 65° C. with a 500 MHZ proton NMR (JEOL GX-500) apparatus. The peak (I) indicates the total sum of the isotacticity chain (4.54 ppm), the heterotacticity chain (4.36 ppm) and the syndiotacticity chain (4.13 ppm) in the triad expression of hydroxyl groups of PVA, and the peak (II) for all of the hydroxyl groups in the vinyl alcohol units appears in the chemical shift region from 4.05 ppm to 4.70 ppm, so that the molar fraction of the hydroxyl group located at the center of three successive vinyl alcohol unit chain in terms of triad expression to the vinyl alcohol unit in this invention is represented as 100×(I)/(II).

If the content of the hydroxyl group located at the center of three successive vinyl alcohol unit chain in terms of triad expression of PVA is less than 70 mol %, the crystallinity of the polymer is lowered to deteriorate the fiber strength and, in addition, the fibers will be glued together upon melt-spinning and cannot sometimes be unwound after winding. Further, the water soluble thermoplastic fibers aimed in this invention cannot be obtained depending on the case.

If the content of the hydroxyl group located at the center of three successive vinyl alcohol unit chain in terms of triad expression of PVA is more than 99.9 mol %, since the melting point of the polymer is high, the melt spinning temperature has to be high and, as a result, the heat stability of the polymer is poor upon melt spinning tending to cause decomposition, gelation and coloration of the polymer.

Further, when the PVA according to this invention is an ethylene modified PVA, the effect of the invention is further improved by satisfying the following equation:

$$-1.5\times Et+100 \geqq \text{molar fraction} \geqq -Et+85$$

in which the molar fraction (mol %) represents the molar fraction of the hydroxyl group located at the center of three successive vinyl alcohol unit chain in terms of triad expression of PVA and Et represents the ethylene content (mol%) contained in the vinyl alcohol polymer.

Accordingly, the content of the hydroxyl group located at the center of three successive vinyl alcohol unit chain in terms of triad expression of PVA used in this invention is, preferably, from 72 to 99 mol % and, more preferably, 74 to 97 mol % and, particularly preferably, 76 to 95 mol %. These ranges include all values and subranges therebetween, including 73, 75, 77, 78, 79, 80, 82, 85, 88, 91, 94 and 97 mol %.

By controlling the amount of the hydroxyl group located at the center of three successive vinyl alcohol unit chain in terms of triad expression of the polyvinyl alcohol used in this invention, water-related properties such as water solubility or hygroscopicity and properties regarding fibers such as strength, elongation and modulus of elasticity, and also melt-spinning related properties such as melting point and melt viscosity of PVA can be controlled. This is considered that the hydroxyl group located at the center of three successive vinyl alcohol unit chain in terms of triad expression are highly crystalline to develop the features of PVA.

The melting point (Tm) of PVA used in this invention, is, preferably, from 160 to 230° C., more preferably, 170 to 227° C. and, further preferably, 175 to 224° C. and, particularly preferably, 180 to 220° C. These ranges include all values and subranges therebetween, including 165, 178, 182, 196, 204, 214, 222 and 338. If the melting point is lower than 160° C., crystallinity of PVA lowers to deteriorate the fiber strength of the conjugate fiber and, at the same time, the heat stability of the conjugate fiber is worsened thereby sometimes making it impossible to form fibers. On the other hand, if the melting point exceeds 230° C., the temperature for melt spinning is elevated and the spinning temperature approaches the decomposition temperature of PVA, so that it is sometimes impossible to stably produce conjugate fibers comprising PVA and other thermoplastic polymer. The melting point of PVA means the temperature at the top of the endothermic peak representing the melting point of PVA when the temperature is elevated to 250° C. at a temperature elevation rate of 10° C./min, cooled to a room temperature and then elevated to 250° C. again at a temperature elevation rate 10° C./min in nitrogen using DSC.

PVA used in this invention is preferably obtained by saponifying vinyl ester units of a vinyl ester polymer. The vinyl compound monomer for forming the vinyl ester unit can include, for example, vinyl formate, vinyl acetate, vinyl propionate, vinyl valeroate, vinyl caprinate, vinyl laurate, vinyl stearate, vinyl benzoate, vinyl pivalate,.and vinyl versatate, vinyl acetate being preferred for obtaining PVA.

PVA used in this invention may be a homopolymer or a modified PVA introduced with copolymerizing units, and it is preferred to use a modified polyvinyl alcohol introduced with a copolymerizing unit in view of the melt spinnability, water solubility and fiber property. The copolymerizing monomer can include, for example, α-olefins such as ethylene; propylene, 1-butene, isobutene and 1-hexene; acrylic acid and salts thereof, acrylic acid esters such as methyl acrylate, ethyl acrylate, n-propyl acrylate and i-propyl acrylate; methacrylic acid and salts thereof and methacrylate such as methyl methacrylate, ethyl methacrylate, n-propyl methacrylate and 1-propyl methacrylate; acryl amide, and acryl amide derivatives such as N-methyl acrylamide and N-ethyl acrylamide; methacrylamide and methacrylamide derivatives such as N-methyl methacrylamide and N-ethyl methacrylamide; vinyl ethers such as methyl vinyl ether, ethyl vinyl, ether, n-propyl vinyl ether, i-propyl vinyl ether and n-butyl vinyl ether; hydroxy group-containing vinyl ethers such as ethylene glycol vinyl ether, 1,3-propanediol vinyl ether and 1,4-butanediol vinyl ether; allyl acetate and allyl ethers such as propyl acetate, butyl allyl ether and hexyl allyl ether; monomers having oxyalkylene groups; vinyl silyls such as vinyl trimethoxysilane; hydroxy group-containing α-olefins such as isopropenyl acetate, 3-butene-1-ol, 4-pentene-1-ol, 5-hexene-1-ol,-7-octene-1-ol, 9-decene-1-ol and 3-methyl-3-butene-1-ol; carboxyl group-containing monomers derived from fumaric acid, maleic acid, itaconic acid, maleic acid anhydride, phthalic acid anhydride, trimellitic acid anhydride, or itaconic acid anhydride; monomers having a sulfonic acid group derived from ethylene sulfonic acid, allyl sulfonic acid, methallyl sulfonic acid, and 2-acrylamide-2-methylpropnane sulfonic acid; and monomers having cationic group derived, for example, from vinyloxy ethyltrimethyl ammonium chloride, vinyloxy butyltrimethyl ammonium chloride, vinyloxy ethyldimethylamine, vinyloxy methyldiethylamine, N-acrylamide methyltrimethyl ammonium chloride, N-acrylamide ethyltrimethyl ammonium chloride, N-acrylamide dimethylamine, allyltrimethyl ammonium chloride, methallyltrimethyl ammonium chloride, dimethylallylamine and allylethylamine. The content of the monomer described above is usually 20 mol % or less.

Among the monomers described above, in view of easy availability, preferred are α-olefins such as, ethylene, propylene, 1-butene, isobutene, and 1-hexene; vinyl ethers such as methyl vinyl ether, ethyl vinyl ether, n-propyl vinyl ether, i-propyl vinyl ether and n-butyl vinyl ether; hydroxy group-containing vinyl ethers such as ethylene glycol vinyl ether, 1,3-propenediol vinyl ether and 1,4-butanediol vinyl ether; allyl acetate and allyl ethers such as propyl allyl ether, butyl allyl ether and hexyl allyl ether; oxyalkylene group-containing monomers; and monomers derived from hydroxy group-containing α-olefins such as 3-butene-1-ol, 4-pentene-1-ol, 5-hexene-1-ol, 7-octene-1-ol, 9-decene-1-of and 3-methyl-3-butene-1-ol.

Particularly, in view of the copolymerizability, melt spinnability and water solubility of fibers, α-olefins having 4 or less carbon atoms such as ethylene, propylene, 1-butene and isobutene; vinyl ethers such as methyl vinyl ether, ethyl vinyl ether, n-propyl vinyl ether, i-propyl vinyl ether and n-butyl vinyl ether are more preferred. The unit derived from α-olefins having 4 or less carbon atoms and/or vinyl ethers is present in PVA by preferably from 0.1 to 20 mol %, more preferably, 1 to 20 mol %, further preferably, 4 to 15 mol % and, particularly preferably, 6 to 13 mol %. These ranges include all values and subranges therebetween, including 2, 3, 5, 7, 12, 16 and 18 mol %.

Further, when α-olefin is ethylene, use of a modified PVA introduced with 4 to 15 mol % and, preferably, 6 to 13 mol % of the ethylene unit is preferred since the fiber properties are enhanced.

For the PVA used in this invention, there can be mentioned known polymerization processes such-as bulk polymerization process, solution polymerization process, suspension polymerization process and emulsification polymerization process. Among them, the bulk polymerization process and the solution polymerization process conducting polymerization with no solvent or in a solvent such as alcohol are usually adopted. The alcohol used as the solvent for solution polymerization can include, lower alcohols such as methanol, ethanol and propanol. Initiators used for copolymerization can include, those known azo-initiators or peroxide initiators, for example, such as α, α'-azobisisobutyronitrile, 2,2'-azobis(2,4-dimethylvaleronitrile), benzoil peroxide and n-propyl peroxy carbonate. The polymerization temperature has no particular restriction and it is suitably within a range from 0° C. to 150° C.

The alkali metal ion content, in terms of sodium ion in PVA used in this invention is, preferably, from 0.0003 to 1 mass parts, more preferably, 0.0003 to 0.8 mass parts, further preferably, 0.0005 to 0.6 mass parts and, particularly preferably, 0.0005 to 0.5 mass parts based on 100 mass parts of PVA. If the content of the alkali metal ions is less than 0.0003 mass parts, water solubility is not sufficient to sometimes remain insoluble matters. Further, if the content of the alkali metal ion is 1 mass part or more, decomposition and gelation are remarkable upon melt spinning making it sometimes impossible to form fibers. The alkali metal ions can include, for example, potassium ions and sodium ions. These ranges include all values and subranges therebetween, including 0.0007, 0.005, 0.05, 0.1, 0.2, 0.3, 0.4, 0.5, 0.6, 0.7 and 0.9.

In this invention, there is no particular restriction on the method of incorporating a specified amount of, alkali metal ions in PVA and the method can include, for example, a method of adding a compound containing alkali metal ions after polymerization of PVA, and a method of using an alkaline substance containing alkali ions as a saponifying catalyst to introduce alkali metal ions in PVA upon saponifying the polymer of the vinyl ester in a solvent and washing the PVA obtained by saponification with the washing liquid thereby controlling the content of the alkali metal ions contained in PVA, the latter method being preferred.

The content of the alkali metal ions can be determined by an atomic absorption analysis.

The alkaline substance used as the saponification catalyst can include, potassium hydroxide and sodium hydroxide. The molar ratio of the alkaline substance used as the saponification catalyst is preferably from 0.004 to 0.5 and, particularly preferably, 0.005 to 0.05 based on the vinyl acetate unit. The saponification catalyst may be added collectively at the initial stage of the saponifying reaction or may be added additionally in the course of the saponifying reaction. These ranges include all values and subranges therebetween, including 0.008, 0.01, 0.05, 0.075, 0.1, 0.2, and 0.3.

The solvent for the saponifying reaction can include, for example, methanol, methyl acetate, dimethyl sulfoxide and dimethyl formamide. Among the solvents, methanol is preferred and methanol controlled to water content of 0.001 to 1 mass % is more preferred, methanol controlled to the water content of 0.003 to 0.9 mass % is more preferred and methanol controlled to water content of 0.005 to 0.8 mass is particularly preferred. The washing liquid can include, for example, methanol, acetone, methyl acetate, ethyl acetate, hexane and water, methanol, methyl acetate and water being preferred and used alone or as a liquid mixture of them. These ranges include all values and subranges therebetween, including 0.01, 0.05, 0.08, 0.1, 0.2, 0.3, 0.4, 0.5, and 0.7.

The amount of the washing liquid is set so as to satisfy the content of the alkali metal ions and, usually, from 300 to 10,000 mass parts are preferred and 500 to 5000 mass parts are more preferred based on 100 mass parts of PVA. These ranges include all values and subranges therebetween, including 400, 700, 900, 1100, 3000, 5500, and 7500. The washing temperature is preferably from 5 to 80° C., and, more preferably, 20 to 70° C. These ranges include all values and subranges therebetween, including 10, 15, 25, 30, 35, 40, 55, 65 and 75° C. The washing time is preferably, from 20 min to 10 hours and, more preferably, 1 to 6 hours. These ranges include all values and subranges therebetween, including 30 min, 45 min, and 2, 3, 4, and 5 hours.

Particularly, when PVA as described above is used in this invention, it is preferred to incorporate an appropriate plasticizer to PVA in view of the physical property and the performance of fiber forming step since PVA is generally poor in the melt flowability at high temperature compared with general purpose thermoplastic resins. The apparent melt viscosity of the plasticizer-containing PVA (island component) at 240° C. and at a shear rate of 1000 $sec^{-1}$ is from 40 to 400 Pa.s and, more preferably, 50 to 350 Pa.s. These ranges include all values and subranges therebetween, including 60, 80, 120, 140, 180, 220, 280, 320, and 380 Pa.s. If the apparent melt-viscosity is less than 40 Pa.s, since the melt-viscosity is excessively low it is difficult to balance the viscosity with the other polymer in conjugate fiber. Further, if the viscosity is intended to be balanced by lowering the polymerization degree of the other polymer of conjugate fiber thereby lowering the melt viscosity, this lowers of the fiber strength.

Further, if the apparent melt-viscosity exceeds 400 Pa.s, since the melt flowability is worsened, the polymer tends to be thermally deteriorated such as by gelation and decomposition.

There is no particular restriction on the kind of the plasticizer to be incorporated in PVA but it is especially preferable that the effect of reducing the viscosity at the apparent melt-viscosity at 240° C. and at a shear rate of 1000 $sec^{-1}$ is from 10 to 200 Pa.s and,. preferably, 20 to 180 Pa.s. These ranges include all values and subranges therebetween, including 30, 40, 60, 80, 120, 140, 170, 160 and 190 Pa.s. If the viscosity reducing effect is less than 10 Pa.s, since there is scarce plasticizing effect, the melt-flowability of PVA is worsened and the polymer tends to be degraded thermally. On the contrary, if the viscosity reducing effect exceeds 200 Pa.s, since the melt-viscosity is excessively low, viscosity balance with the composite polymer is lost making it impossible for spinning.

The plasticizer providing the viscosity reducing effect at a melt-viscosity of 10 to 200 in Pa.s, at 240° C. and at a shear rate of 1000 $sec^{-1}$ include, for example, polyethylene glycol, propylene glycol and oligomers thereof, butylene glycol and oligomers thereof, polyglycerine derivatives and glycerine derivatives formed by adding an alkylene oxide, for example, ethylene oxide or propylene oxide to glycerine, derivatives formed by adding an alkylene oxide, for example, ethylene oxide or propylene oxide to sorbitol, polyhydric alcohols such as pentaerythritol, and PO/EO random copolymers. Stringiness is improved by blending the plasticizer at a ratio of 1 to 30 mass % and, preferably, 2 to 20 mass % to PVA. These ranges include all values and subranges therebetween, including 4, 5, 6, 8, 10, 12, 18, 22 and 24 mass %.

In particular, it is preferred to introduce a plasticizer such as an alkylene oxide adduct of sorbitol, polyglycerine alkyl monocarboxylic acid ester or PO/EO random copolymer by 1 to 30 mass %, preferably, 2 to 20 mass % for suppressing heat decomposition in the fiber forming step and obtaining satisfactory plasticity and spinnability. These ranges include all values and subranges therebetween, including 4, 5, 6, 8, 10, 12, 14, 16, 22, 24 and 28 mass %. Particularly, a compound formed by adding 1 to 30 mol of ethylene oxide to one mol of sorbitol is preferred.

A compound formed by adding 1 to 30 mol of ethylene oxide to 1 mol of sorbitol is to be explained below. When the average addition mol number of ethylene oxide is less than 1, while there is no problem in the compatibility with PVA, there is a drawback in the heat stability since the molecular weight is low. On the contrary, when the average addition mol number of ethylene oxide exceeds 30, since SP value is lowered, compatibility with PVA is worsened to give undesired effect for the performance of the fiber forming step. The addition mol number is an averaged value and the addition mol number may have a distribution but it is not preferred to incorporate more than 30 mol of adduct by 50 mass % or more.

The content based on PVA is, preferably, from 1 to 30 mass % and, more preferably, from 2 to 20 mass %. These ranges include all values and subranges therebetween, including 3, 4, 5, 6, 7, 8, 9, 12, 16, 18, 22, 24, 26 and 28 mass %. If the content is less than 1 mass %, the plasticizing effect is insufficient and, on the other hand, if it exceeds 30 mass %, balance of viscosity relative to the composite polymer is lost to bring about a problem of worsening the performance of the fiber forming step.

Further, the average molecular weight of the compound is preferably about 200 to 1500. There is no particular restriction on the method of adding the compound as the plasticizer to PVA but a method of forming a master chip by using a twine screw extruder is preferred in view of uniform dispersion of the plasticizer.

The thermoplastic polymer constituting the hollow fiber of this invention has no particular restriction so long as the equilibrium water content is 2% or less and can include, for example, polyolefinic polymers such as polyethylene, polypropylene and polymethylpentene, polyesters such as polyethyelene terephthalate, polybutylene terephthalate, polyhexamethylene terephthalate and polypropylene terephthalate; polylactic acid, polyphenylene sulfide, polyallylate, polycarbonate, polymethyl methacrylate, polyvinyl chloride, polyvinylidene chloride, polyurethane, polybutadiene, hydrogenated polybutadiene, polyisoprene, hydrogenated polyisoprene, a copolymer of an aromatic vinyl monomer and a diene monomer or hydrogenation products thereof. Further, such polymers may be modified, for example, by copolymerization so long as the equilibrium water content is within a range capable of satisfying the condition of the invention. Particularly, in the polyester series, it is a preferred approach to conduct copolymerization, for example, with isophthalic acid, 5-sodium sulfoisophthalic acid, sebatic acid and adipic acid in view of the easy removability of PVA as the island component of the conjugate fiber. Particularly, in the case of using the polyester, it is preferred to use such a polyester having an intrinsic viscosity $\{\eta\}$ of 0.52 to 0.85 dl/g when measured by using a Ubbelohde type viscometer in an o-chlorophenol solution at a concentration of 1 g/100 cc and at 30° C., in view of the spinnability and the porous hollow structure of the obtained conjugate fiber. When the intrinsic viscosity is lower than 0.52, fluffing and fiber breakage occur in the fiber forming step tending to deteriorate the performance of the step, as well as the porous hollow structure of the conjugate fiber is poor. On the other hand, if the viscosity increases in excess of 0.85, it is also not preferred since the performance of the fiber forming step is poor and formation of the porous hollow structure is difficult.

Further, additives such as fine inorganic particles may be incorporated in the thermoplastic polymer constituting the sea component.

In this invention, the equilibrium water content can be measured according to JIS L 1015-1992, under the condition 20°±2° C. and 65±2% RH, the entire contents of which are hereby incorporated by reference.

Particularly, for high speed spinning in spinning direct coupled drawing, for example, by using a tube heater in fiber formation, it is preferred to add fine inorganic particles to the polymer so as to satisfy specific conditions. It is preferred that the average primary particle size of the fine inorganic particles in the sea component polymer ($\mu$m) is from 0.01 $\mu$m to 5 $\mu$m, the content thereof (mass %) in the polymer is from 0.05 to 10 mass % and the product thereof (X) satisfies: $0.01 \leqq X \leqq 3.0$.

The particle size range includes all values and subranges therebetween, including 0.05, 0.07, 0.1, 0.2, 0.3, 0.4, 0.5, 0.6, 0.7, 0.8, 0.9, 1, 2, 3, and 4 $\mu$m. The particle content range includes all values and subranges therebetween, including 0.07, 0.1, 0.2, 0.4, 0.6, 0.8, 1, 2, 3, 4, 5, 6, 7, 8, and 9 mass %, based on the weight of the sea component polymer. The X value range includes all values and subranges therebetween, including 0.02, 0.03, 0.05, 0.07, 0.09, 1, 1.1, 1.4, 1.5, 2.1 and 2.4.

If the product X is less than 0.01, loops, fluffing and unevenness of yam occur in the conjugate fiber to sometimes make step performance poor.

If the product X exceeds 3.0, while the porous hollow structure is satisfactory in the post fabrication but fluffing and fiber breakage occur frequently in the fiber forming step to undesirably deteriorate the step performance.

Any kind of fine inorganic particles can be used so long as they do not remarkably deteriorate the polymer forming fibers and the fine inorganic particles are excellent per se in the stability. Typical examples of the fine inorganic particles usable effectively in this invention can include, for example, silica, alumina, calcium carbonate, titanium oxide and barium sulfate, which may be used alone or in a combination of two or more of them. When they are used in combination by two or more of them, it is preferable that the sum for the products of the primary average particle size ($a_1, a_2, \ldots a_{11}$) and the content ($b_1, b_2, \ldots b_{11}$) for respective fine inorganic particles can satisfy the above-mentioned range. That is, X represented by: $X=a_1 \times b_1+a_2 \times b_2+ \ldots a_{11} \times b_{11}$ should satisfy the range described above.

As described above, the primary average grain size of the fine inorganic particles is, preferably, from 0.01 to 5.0 μm and, more preferably, 0.03 to 3.0 μm. When the primary average grain size of the fine inorganic particles is less than 0.01 μm, loops, fluffing and unevenness of yarn occur to the conjugate fibers even when slight fluctuations occur in temperature of the heating zone for drawing and running speed of strand and tension applied on the running yard strand. On the other hand, when the primary average grain size of the fine inorganic particles exceeds 3.0 μm, the fiber drawability is lowered to make the yarn forming property poor tending to cause breakage upon production of the conjugate fiber. The primary average grain size of the fine organic particles means the value when measured by using a centrifugal precipitation method.

Further, the content of the fine inorganic particles in this invention is, preferably, from 0.05 to 10.0 mass % and, more preferably, 0.3 to 5.0 mass % based on the mass of the sea component polymer. When the content of the fine inorganic particles is less than 0.05 mass % based on the mass of the polymer, loops, fluffing and unevenness of yarn occur to the conjugate fibers even when slight fluctuations occur in temperature of the heating zone for drawing and running speed of strand and tension applied on the running yard strand. On the other hand, if the content of the fine inorganic particles exceeds 10.0 mass %, the fine inorganic particles make the resistance excessive between the running fiber strand and air in the fiber drawing step, which leads to occurrence of fluffing and fiber breakage to make the step unstable.

There is no particular restriction on the method of adding the fine inorganic particles into the polymer; and they may be added and mixed such that the fine organic particles are uniformly mixed at any stage just prior to the melt spinning of the polymer. For example, the fine inorganic particles may be added at any instance during polycondensation of the polymer, may be added subsequently, for example, during production of pellets to the polymer completed with polycondensation, or the fine inorganic particles may be melt-mixed at a stage prior to the discharge of the polymer out of the spinneret.

There is no particular restriction on the conjugate fibers used in the production of the hollow fibers in this invention regarding the fiber forming technique so long as it is a spinning technique capable of forming the cross sectional form using the island component as PVA and the thermoplastic polymer with an equilibrium water content of 2% or less as the sea component and, for example, a method by mixed spinning is possible in the combined system of a polymer not gelling by reaction with PVA as the island component upon hot melting, in which PVA as the island component and the thermoplastic polymer as the sea component can be melt kneaded in one extruder and then discharged through an identical spinning nozzle and taken-up to form fibers.

Further, by the conjugate spinning method, PVA and thermoplastic polymer are melt kneaded, respectively, in separate extruders, subsequently, discharged from a sea-island type conjugate spinning nozzle such that the PVA constitutes the island component and the thermoplastic polymer constitutes the sea component and then taken up and formed into the fibers.

The fiber forming conditions have to be set in accordance with the combination of polymers and the form of the conjugate cross section and the fiber forming conditions are desirably determined taking notice on the following points.

(1) Generally, since PVA is a polymer which is poor in the melt-flowability at high temperature and self crosslinks in the presence of a stagnation portion tending to gel, it is important to suppress the occurrence of stagnation in the polymer flowing portion as much as possible in a polymer extrusion zone and in a jet pack (an assembly of conjugate spinning parts).

(2) The spinneret temperature is preferably between Mp and Mp+80° C. where Mp is a melting point of a polymer having higher melting point of the polymers constituting the conjugate fiber and spinning is preferably conducted at a shear rate (γ) of from 1,000 to 25,000 $sec^{-1}$ and at a draft V of from 10 to 500. The shear rate range includes all values and subranges therebetween, including 1500, 2000, 5000, 7500, 10,000, 15,000, 17,500, 20,000 and 22,000 $sec^{-1}$. The draft V range includes all values and subranges therebetween, including 20, 50, 75, 100, 125, 150, 200, 250, 300, 350 and 400.

(3) In view of the combination of the composited polymers, it is preferred in view of the spinning stability to conduct conjugate spinning in a combination of polymers having melt viscosities close to each other when measured at a spinneret temperature and shear rate upon passage of the nozzle during spinning.

The melting point Tm of PVA in this invention is a peak temperature for the main endothermic peak observed by a differential scanning calorimeter (DSC: for example, TA3000 manufactured by Mettler Co.). The shear rate (γ) is calculated as $\gamma=4Q/\pi r^3$ in which r (cm) represents a nozzle radius and Q ($cm^3$/sec) represents a polymer discharge amount per single hole. Further, the draft V is calculated as $V=5A \cdot \pi r^2/3Q$ in which A (m/min) represents a take-up speed.

Upon production of the conjugate fiber, if the spinneret temperature is lower than the melting point Tm of PVA, the fiber can not be spun since the PVA does not melt. On the contrary, if the temperature exceeds Tm+80° C., the spinnability is lowered since PVA tends to cause gelation by heat decomposition or self crosslinking. Further, if the shear rate is 1000 $sec^{-1}$ or lower, fiber tends to be broken easily and, if it is 25,000 $sec^{-1}$ or higher, the back pressure to the nozzle is increased to worsen the spinnability. When draft is 10 or lower, fiber fineness becomes uneven making it difficult for stable spinning and if the draft is 500 or higher, the fiber tends to be broken readily.

The strand discharged from the spinning nozzle is taken up as it is at a high speed without drawing or it is drawn if required. Drawing is conducted at a draw ratio of elongation at break (HDmax)×(0.55 to 0.9) at a temperature of the glass transition point (Tg) or higher.

If the draw ratio is less than HDmax×0.55, conjugate fiber of sufficient strength can not be obtained stably and if it exceeds HDmax×0.9, the fiber tends to be broken. Drawing is applied after once taking up the fiber discharged from the spinning nozzle or applied subsequent to the drawing, either of which may be adopted in this invention. Drawing may be conducted usually under heating by using any of hot blow, hot plate, hot roller or water bath.

In the drawing step, since fluffing and fiber breakage tend to occur more readily as the absolute value of the draw ratio increases, it is preferred to adopt fiber forming conditions by high speed spinning and low draw ratio, or by the known high speed spinning and subsequent direct taking up, without drawing.

The drawing temperature is properly set in accordance with the combined polymers in the conjugate fiber, but polyvinyl alcohol used in this invention shows high crystallizing rate and crystallization of undrawn fiber proceeds considerably and plastic deformation in the crystallized portion less occurs at about Tg. Accordingly, in the case of conjugation with PET for instance, drawing is applied aiming at a relatively high temperature (about 70 to 100° C.) also in a case of contact heat drawing such as in hot roller drawing. Further, when drawing is conducted under heating by using a heating furnace or a non-contact type heater such as heating tube, it is preferred to adopt a further higher temperature condition of about 150 to 200° C.

However, it is preferable in this invention to conduct spinning at a spinneret temperature between Tm and Tm+80° C., at a shear rate ($\tau$) of 1000 to 25000 $sec^{-1}$ and at a draft (V) of 10 to 500.

Further, there is no particular restriction on the cross sectional shape of the conjugate fiber in this invention and it may be a circular shape, hollow shape or profiled cross sectional shape depending on the shape of a spinning nozzle. A circular shape is preferred in view of the step passage in forming fibers or woven fabrics.

In the conjugate fiber according to this invention, the shrinking behavior of the conjugate fiber can be controlled upon dissolution of PVA as the island component in water depending on the production conditions and it is preferred to apply a heat treatment to the conjugate fiber in a case where the conjugate fiber does not shrink or the amount of shrinkage is intended to be retained upon dissolution of PVA. The heat treatment may be applied simultaneously with drawing in the fiber forming step accompanied with drawing, or the heat treatment may be applied independently of drawing. As the heat treatment temperature is increased, it is possible to lower the maximum shrinkage of the hollow fiber obtained by dissolving the island component PVA but this tends to make the dissolution temperature of the island component PVA into water higher. Accordingly, it is desirable to set the heat treatment condition in view of the balance with the maximum shrinkage in the fabrication step of the conjugate fibers and it is preferred that the conditions are set generally within the range from the glass transition point to (Tm−10)° C. of the island component PVA.

If the treating temperature is lower than Tg, sufficiently crystallized conjugate fiber can not be obtained and, for example, shrinkage is increased upon use when formed into fabrics under heat setting, which hardens the hand of the fabric and is not preferred. Further, when the treatment temperature exceeds (Tm−10)° C., it causes gluing between each of fibers, which is not preferred.

The heat treatment may be conducted by applying shrinkage to the conjugate fiber after drawing. When shrinkage is applied to the conjugate fiber, the shrinkage of the conjugate fiber in water till the solution of PVA is reduced. The shrinkage applied is preferably from 0.01 to 5%, more preferably, 0.1 to 0.5% and, particularly preferably 1 to 4%. These ranges include all values and subranges therebetween, including 0.05, 0.5, 1.1, 2, 2.5, 3, 3.5 and 4.5%. If the shrinkage applied is 0.01 or less, an effect of decreasing the maximum shrinkage of the conjugate fiber can not be obtained substantially upon dissolving PVA and, on the other hand, if the shrinkage applied exceeds 5%, the conjugate fiber sags during the shrinkage treatment failing to apply stable shrinkage.

In this invention, "water soluble" for PVA means that PVA dissolves at a temperature of 40° C. or higher, irrespective of the time till dissolution. By changing the type of PVA and the production conditions for the conjugate fiber, a conjugate fiber having the dissolution temperature of PVA as the island component of 30° C. to 100° C. can be obtained in this invention. However, for practicality and establishing the balance of all characteristics of water solubility, a conjugate fiber comprising PVA island component having a dissolution temperature of 40° C. or higher is preferred. These ranges include all values and subranges therebetween, including 50, 60, 70, 80, 90, and 110° C.

The temperature for the dissolving treatment may be properly controlled in accordance with the dissolution temperature of PVA and the glass transition point at the wet state of the thermoplastic polymer constituting the sea component of the conjugate fiber and the treatment time is naturally shortened as the treatment temperature is higher. In a case of using hot water for dissolution, when the glass transition point of the thermoplastic polymer as the sea component is 70° C. or higher, a hot water treatment under a high pressure and at a high temperature of 100° C. or higher is most preferred. Usually soft water is used for the aqueous solution but it may be an aqueous alkaline solution or an aqueous acidic solution, or it may contain a surfactant or the like.

When the hollow fiber is obtained by applying a hot water treatment to the conjugate fiber and removing the PVA component by dissolution, the treatment may be conducted by using a scouring agent comprising a nonionic surfactant or anionic surfactant, as well as other additives.

Further, dissolution and removal of PVA by the hot water treatment may be conducted to the conjugate fiber itself or the hot water treatment may be applied after constituting the fiber structure containing the conjugate fiber.

The temperature and the time of the hot water treatment can be controlled properly depending on various conditions such as the fineness of the conjugate fiber, the ratio of the island component in the conjugate fiber, the distribution state of the island component, the ratio and the kind of the thermoplastic polymer as the sea component and the form of the fiber structure. The hot water treatment temperature is at 60° C. or higher and, preferably, 80° C. or higher.

The hot water treatment method can include, for example, a method of immersing the conjugate fiber or the fiber structure into hot water, or a method of applying hot water to them by means of padding or spraying.

In this invention, PVA is removed as an aqueous solution from the conjugate fiber by the hot water treatment as described above and such PVA has biodegradability and when, put to activated sludge treatment or buried in earth, it is decomposed into water and carbon dioxide. Further, when the PVA removed by dissolution is treated continuously in the state of an aqueous solution with activated sludges, it is decomposed substantially completely in two days–one month. In view of the biodegradability, the saponification degree of the fiber is preferably from 90 to 99.99 mol %, more preferably, 92 to 99.98 mol % and, particularly preferably, 93 to 99.97 mol %. These ranges include all values and subranges therebetween, including 91, 94, 95, 96, 97, 98 and 99 mol %. Further, the 1,2-glycol bond content in the fiber is preferably from 1.0 to 3.0 mol %, more preferably, 1.2 to 2.5 mol % and, particularly preferably, 1.3 to 1.9 mol %. These ranges include all values and subranges therebetween, a including 1.1, 1.5, 1.8, 2.1, 2.3, 2.7 and 2.9 mol %.

If 1,2-glycol content of PVA is less than 1.0 mol %, not only the biodegradability of PVA is worsened but also the melt-viscosity is excessively high to sometimes worsen the spinnability of the conjugate fiber. On the contrary, if the 1,2-glycol bond content of PVA is 3.0 mol % or more, the heat stability of PVA is worsened to sometimes lower the spinnability.

In this invention, PVA in the conjugate fiber is selectively removed by the hot water treatment and a hollow fiber comprising a thermoplastic polymer with equilibrium water content of 2% or less is produced. One of most prominent features of this invention is that the PVA as the island component is completely surrounded with the sea component comprising a thermoplastic polymer such as polyester or polypropylene in which 85 mol % or more of the basic skeleton is polyethylene terephthalate or polybutylene terephthalate that is considered to be hardly water-swellable, but PVA is thoroughly dissolved and removed by the hot water treatment to form a hollow fiber. In a case where the conjugate fiber has cut faces such as in staple fibers, it may be considered that PVA is removed from the end faces of the fiber. However, PVA is thoroughly dissolved and removed in this invention even if it is in a state of a continuous fiber having no substantial cut faces, and such a fact can be said to overthrow the established theory.

Particularly, while polyester fibers or polypropylene fibers having a porous hollow structure cannot be obtained easily thus far even by incorporating a blowing agent or by way of an extremely special method, they can be produced extremely reasonably and practically by using the conjugate fibers according to this invention.

Further, since the PVA as the island component is excellent in the hygroscopicity and temperature keeping property, it may also be possible to partially dissolve and remove PVA to form gaps while leaving PVA for the island component by utilizing the characteristic depending on the intended application uses.

The thus obtained hollow fibers according to this invention, having lightness, soft and flexibility, opaque appearance and bulky feel, are particularly suitable to woven fabrics such as taffeta, decyne, georgette, crape, fabricated yarns, woven fabrics such as twills or knitted fabrics such as plain stitches, interlocks and tircots. In addition, the hollow fibers are not restricted only to the use of clothing but also applicable for non-woven fabrics, medical application uses, sanitary materials and various kinds of living materials as fiberfill, as well as utilizable as interior materials, sound absorbers and dampers for automobiles as fiber laminates and, further, can be made into paper.

The hollow fiber according to the invention is composed of a polymer not showing water absorbing property and excellent in lightness, dry feel and bulky feel, as well as a fiber structure containing the hollow fiber, the fiber being prepared by treating, with water, a fiber structure containing sea-island type conjugate fiber composed of a thermoplastic polymer with an equilibrium water content of 2% or less as a sea component and a water soluble thermoplastic polyvinyl alcohol polymer as an island component, and dissolving to remove the water soluble thermoplastic polyvinyl alcohol polymer from the conjugate fiber.

EXAMPLES

Having generally described this invention, a further understanding can be obtained by reference to certain specific examples which are provided herein for purposes of illustration only and are not intended to be limiting unless otherwise specified. The "parts" and "%" in the examples are on the mass basis unless otherwise specified.

PVA Analyzing Method

The PVA analyzing method was according to JIS K6726 unless otherwise specified.

The degree of modification was determined by the measurement in 500 MHZ proton NMR (JEOL GX-500) apparatus, using modified polyvinyl ester or modified PVA.

The alkali metal ion content was determined through an atomic absorption method.

The 1,2-glycol bond content was measured by the method as described previously.

The ratio for amount of hydroxyl groups, in three successive hydroxyl chains in terms of the triad expression of PVA of this invention was determined by the following measurement.

PVA was saponified to a saponification degree of 99.5 mol % or more, washed sufficiently with methanol and then dried at 90° C. under reduced pressure for two days, dissolved in d6-DMSO and then measured in a 500 MHZ proton NMR (JEOL GX-500) apparatus at 65° C. The peak of the vinyl alcohol unit derived from the hydroxyl group in PVA appears in a region of the chemical shift from 4.05 ppm to 4.70 ppm and an integrated value thereof is defined as a vinyl alcohol unit amount (II). Hydroxyl group located at the center of three successive hydroxyl group chain in terms of the triad expression of PVA appears at 4.5 ppm in a case of the isotacticity chain, at 4.36.ppm in a case of the heterotacticity chain and at 4.13 ppm in a case of the syndiotacticity chain. The sum of the integrated values for three of them is defined as the amount of, the hydroxyl group located at the center of three successive hydroxyl group chain (I) in terms of the triad expression.

The molar fraction of the hydroxyl group located at the center of three successive hydroxyl group chain in terms of the triad expression to the vinyl alcohol unit of the PVA of this invention is represented as: 100×(I)/(II).

Melting Point

For measuring the melting point of PVA, the temperature was elevated to 250° C. in nitrogen at a temperature elevation rate of 10° C./min and then cooled to a room temperature and, again, temperature was elevated to 250° C. at a temperature elevation rate of 10° C./min using DSC (TA3000, manufactured by Mettler Co.) and the melting point was represented as a top temperature for the endothermic peak showing the melting point of PVA.

Apparent Melt-Viscosity and Viscosity Reducing Effect

The apparent melt-viscosity of PVA polymers (with and without plasticizer) at 240° C. are measured by using Capillograph 1C PMD-C manufactured by Toyo Seiki Seisakusho Co. Then, the apparent melt-viscosities at a shear rate of 1000 $sec^{-1}$ are-determined respectively and calculated from the following equation.

Viscosity reducing effect (Pa.s)=(apparent melt-viscosity without plasticizer)−(apparent melt-viscosity with plasticizer)

Evaluation for the Fiber Forming Step Performance

◎: No breakage occurs at all during spinning and no fluffing occurs at all to the thus obtained conjugate fiber and the fiber spinnability is excellent.

○: No breakage occurs during spinning and slight fluffing occurs to the thus obtained conjugate fiber but the fiber spinnability is substantially favorable.

Δ: Fiber breakage occurs up to three times and the fiber spinnability is poor.

x: Fiber breakage occurs more than three times and the fiber spinnability is extremely poor.

Removal Ratio of PVA in Hot Water

For the conjugate fiber according to this invention, the mass reduction ratio after treatment with hot water at (Tα+40)° C. for 40 min, water washing for 5 min and drying was defined as a PVA removing ratio in which Tα (° C.) represents the dissolving temperature of PVA constituting, the conjugate fiber in hot water. Tα can be determined, for example, by applying a 2.2 mg/dtex load to the fiber consisting only of PVA, suspending it in water and elevating the water temperature and deciding Tα as a temperature at which the fiber is broken.

Measurement for the Hollow Portion Area Ratio (Hollow ratio)

The transverse cross section of a hollow fiber yarn was photographed by SEM and the area ratio was calculated based on the porous hollow portion area and the entire hollow fiber area at the transverse cross section.

Evaluation for Hand (Lightness, Feeling)

Evaluation was conducted on woven fabrics by ten test panelers and evaluated by the following standards.

◎: 9 or more panelers judged feels to be excellent for all of lightness, softness and bulkiness.

○: 7 to 8 panelers judged feels to be excellent for all of lightness, softness and bulkiness.

Δ: 5 to 6 panelers judged feels to be excellent for all of lightness, softness and bulkiness.

x: 6 or more panelers judged feels to be poor for all of lightness, softness and bulkiness.

Production of Ethylene Modified PVA 29.0 kg of vinyl acetate and 31.0 kg of methanol were charged into a 100-liter pressure reaction vessel equipped with a stirrer, a nitrogen inlet, an ethylene inlet and an initiator inlet, heated at 60° C., and then substituted with nitrogen by bubbling with a nitrogen gas for 30 minutes. Next, ethylene was introduced to elevate the pressure in the reaction vessel to 5.9 kg/cm$^2$ (5:8×10$^6$ Pa). An initiator 2,2'-azobis(4-methoxy-2,4-dimethylvaleronitrile) (AMV) was dissolved in methanol to prepare a solution at a concentration of 2.8 g/liter. After nitrogen substitution by bubbling with a nitrogen gas and controlling the inner temperature of the reaction vessel to 60° C., 170 ml of the initiator solution was charged to start polymerization. During the polymerization, ethylene was introduced into the reaction vessel to keep the at 5.9 kg/cm$^2$ (5.8×10$^5$ Pa) and the polymerization temperature at 60° C. in the reaction vessel, while the solution of the initiator (AMV) was continuously added at a flow rate of 610 ml/hr to conduct polymerization. After 10 hours, when the degree of polymerization reached 70%, the system was cooled to stop the polymerization. The reaction vessel was opened to release ethylene from it and a nitrogen gas was bubbled to completely release ethylene. Next, the non-reacted vinyl acetate monomer was removed from the reaction vessel under reduced pressure to leave a methanol solution of polyvinyl acetate. Methanol was added to the obtained methanol solution of polyvinyl acetate to control the solution to a concentration of 50%. To 200 g of the resulting methanol solution of polyvinyl acetate (contained 100 g of polyvinyl acetate in the solution), 46.5 g of an alkali solution (methanol solution of 10% NaOH) was added (at 0.10 molar ratio (MR) of NaOH to the vinyl acetate units in polyvinyl acetate), to conduct saponification. About 2 minutes after the alkali addition, the system gelled, which was ground by the use of a grinder and left at 60° C. for 1 hour to proceed saponification. Then, 1000 g of methyl acetate was added to neutralize the remaining alkali. After conforming complete neutralization by using a phenolphthalein indicator. 1000 g of methanol was added to the PVA obtained as white solids by filtration, left at room temperature for 3 hours and then dried. The washing operation was repeated three times and then the treated products were centrifuged to remove the liquid, and the resulting PVA was left in a drier at 70° C. for 2 days to obtain a dried PVA.

The ethylene-modified PVA thus obtained had a degree of saponification of 98.4 mol %. When the modified PVA was ashed, dissolved in acid and subjected to atomic absorptiometry, the sodium content of the modified PVA thus obtained was 0.01 mass parts relative to 100 mass parts of the modified PVA.

Further, the methanol solution of polyvinyl acetate having been obtained by removing the non-reacted vinyl acetate monomer after polymerization was purified through precipitation in n-hexane followed by dissolution in acetone. After repeating the process of re-precipitative purification three times, final precipitates were dried at 80° C. under reduced pressure for 3 days to obtain pure polyvinyl acetate. When the pure polyvinyl acetate was dissolved in DMSO-d6, and subjected to 500 MHZ proton NMR (with JEOL GX-500) at 80° C., the ethylene content was found to be 8.4 mol %. The methanol solution of polyvinyl acetate was saponified at an alkali molar ratio of 0.5, ground, and then left at 60° C. for 5 hours to proceed the saponification, and subjected to Soxhlet extraction with methanol for 3 days, and then dried at 80° C. under reduced pressure for 3 days to obtain pure ethylene-modified PVA. The average degree of polymerization of the PVA was 330 when measured according to an ordinary method of JIS K6726. The 1,2-glycol bond content and the content of a hydroxyl group in three successive hydroxyl group content of the pure PVA were 1.50 mol % and 83 mol %, respectively, when measured in 500 MHZ proton NMR (with JEOL GX-500) according to the method mentioned above.

An aqueous solution of 5% pure modified PVA was prepared, and cast to form a film having a thickness of 10 microns. The film was dried at 80° C. under reduced pressure for 1 day, and subjected to DSC (TA3000 manufactured by Mettler Co.) according to the method mentioned the melting point of PVA was 208° C.

EXAMPLE 1

The modified PVA obtained as described above was used as the island component, while isophthalic acid 6 mol % modified polyethylene terephthalate containing 0.045 mass % of titanium oxide ({η}=0.68, hereinafter simply referred to as IPA6coPET) was used as the sea component. After spinning them at a highest zone temperature of PVA of 230° C., at a spinning temperature of 260° C. and at a spinning rate of 1800 m/min by using conjugate spinning parts so as to suppress melt stagnation of PVA as less as possible, undrawn fiber was in contact with a hot roller at 83° C. and a hot plate at 140° C. and drawn at a drawn ratio of 2.3 to obtain a conjugate fiber of 83 dtex/24f having the fiber cross section and conjugate ratio as shown in Table 1.

Then, plain woven fabrics were prepared by using the conjugate fibers as wefts and warps. The weft density was 95 N/25.4 mm and the warp density was 86 N/25.4 mm. The woven fabrics were desized by immersing in an aqueous solution containing sodium carbonate at a ratio of 2 g/l at 80° C. for 30 min, and then pre-setting was conducted at 170° C. for about 40 sec. Then, a hot water treatment was conducted in an aqueous solution containing 1 g/l of Intall MT-conc (anionic agent, manufactured by Meisei Kagaku Co.) at a bath ratio of 50:1 and at a temperature of 120° C. for 40 min period. After washing with water thoroughly, plain woven fabrics having the PVA removal ratio and the hollow area ratio shown in Table 1 were obtained. The result of evaluation for the woven fabrics having lightness is shown in Table 1.

TABLE 1

Figure 2:
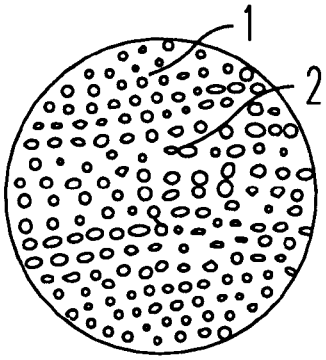
FIG. 2 is a cross sectional view of a fiber illustrating an example of a cross sectional shape of a conjugate fiber according to this invention.

| | Fiber forming condition | | | | | | | | | | | |
|---|---|---|---|---|---|---|---|---|---|---|---|---|
| | Island (core) component polymer | | | | | | | Number of | | Island | | |
| | Sea (sheath) component polymer | Modifying species | Modification amount mol % | Polymerization degree | Saponification degree (%) | Plasticizer | Fiber cross section | island (= number of hollow portion | Conjugate ratio sea/island (mass ratio) | component removal ratio (%) | Hollow ratio (%) | Step performance |
| Ex. 1 | IPA6coPET | Ethylene | 8.4 | 330 | 98.5 | none | FIG. 1 | 9 | 80/20 | 100 | 20 | ◎ |
| 2 | IPA6coPET | Ethylene | 8.4 | 330 | 98.5 | none | FIG. 1 | 16 | 40/60 | 100 | 60 | ○ |
| 3 | IPA6coPET | Ethylene | 8.4 | 330 | 98.5 | none | FIG. 1 | 28 | 70/30 | 100 | 30 | ◎ |
| 4 | IPA6coPET | Ethylene | 8.4 | 330 | 98.5 | none | FIG. 1 | 37 | 70/30 | 100 | 30 | ◎ |
| 5 | IPA6coPET | Ethylene | 8.4 | 330 | 98.5 | none | FIG. 2 | 300 | 70/30 | 100 | 30 | ◎ |
| 6 | IPA6coPET | Ethylene | 4 | 330 | 98.5 | none | FIG. 1 | 37 | 80/20 | 100 | 20 | ◎ |
| 7 | IPA6coPET | Ethylene | 10 | 330 | 97.5 | none | FIG. 1 | 37 | 80/20 | 100 | 20 | ◎ |
| 8 | IPA6coPET | Propylene | 6 | 330 | 98.5 | none | FIG. 1 | 37 | 80/20 | 100 | 20 | ◎ |
| 9 | IPA6coPET | Ethyl vinyl ether | 8 | 330 | 98.5 | none | FIG. 1 | 37 | 80/20 | 100 | 20 | ◎ |
| 10 | PBT | Ethylene | 8.4 | 330 | 98.5 | none | FIG. 1 | 37 | 70/30 | 100 | 30 | ◎ |
| 11 | SIP1.7CoPET | Ethylene | 8.4 | 330 | 98.5 | none | FIG. 1 | 37 | 70/30 | 100 | 30 | ◎ |
| 12 | PET | Ethylene | 8.4 | 330 | 98.5 | none | FIG. 2 | 300 | 70/30 | 100 | 30 | ○ |
| 13 | PLLA | Ethylene | 8.4 | 330 | 98.5 | none | FIG. 3 | 28 | 70/30 | 100 | 30 | ◎ |
| 14 | PPT | Ethylene | 8.4 | 330 | 98.5 | none | FIG. 1 | 37 | 80/20 | 100 | 20 | ◎ |
| 15 | PP | Ethylene | 8.4 | 330 | 98.5 | none | FIG. 1 | 28 | 70/30 | 100 | 30 | ◎ |
| 16 | IPA6coPET | Ethylene | 8.4 | 330 | 98.5 | none | FIG. 3 | 37 | 97/3 | 100 | 3 | ○ |
| 17 | PET | Ethylene | 8.4 | 330 | 98.5 | none | FIG. 4 | 1200 | 70/30 | 100 | 30 | ◎ |
| 18 | IPA6coPET | Ethylene | 8.4 | 330 | 98.5 | A[1)] | FIG. 1 | 37 | 80/20 | 100 | 20 | ◎ |
| 19 | IPA6cOPET | Ethyleoe | 4 | 330 | 98.5 | B[2)] | FIG. 1 | 37 | 80/20 | 100 | 20 | ◎ |
| 20 | IPA6coPET | Propylene | 6 | 330 | 98.5 | C[3)] | FIG. 1 | 37 | 80/20 | 100 | 20 | ◎ |
| 21 | PP | Ethylene | 8.4 | 330 | 98.5 | A | FIG. 4 | 300 | 70/30 | 100 | 30 | ◎ |
| 22 | PET | Ethylene | 8.4 | 330 | 98.5 | A | FIG. 4 | 1200 | 70/30 | 100 | 30 | ◎ |

| | Evaluation for hand | |
|---|---|---|
| | Lightness | Hand |
| Ex. 1 | ○ | ○–◎: Bulkiness, soft hand |
| 2 | ◎ | ○: Bulky feel, soft feel but somewhat scarf tone |
| 3 | ○–◎ | ◎: Bulkiness, extremely soft, antidrape stiffness |
| 4 | ○–◎ | ◎: Bulkiness, extremely soft, antidrape stiffness |
| 5 | ○–◎ | ◎: Bulkiness, extremely soft, antidrape stiffness |
| 6 | ○ | ○–◎: Bulkiness, soft hand |
| 7 | ○ | ○–◎: Bulkiness, soft hand |
| 8 | ○ | ○–◎: Bulkiness, soft hand |
| 9 | ○ | ○–◎: Bulkiness, soft hand |
| 10 | ○–◎ | ◎: Bulkiness, extremely soft, antidrape stiffness |
| 11 | ○–◎ | ◎: Bulkiness, extremely soft, antidrape stiffness |
| 12 | ○–◎ | ◎: Bulkiness, extremely soft, antidrape stiffness |
| 13 | ○–◎ | ◎: Bulkiness, extremely soft, antidrape stiffness |
| 14 | ○ | ○–◎: Bulkiness, soft hand |
| 15 | ○–◎ | ◎: Bulkiness, extremely soft, antidrape stiffness |
| 16 | ○ | ○: Some bulkiness, somewhat soft hand |
| 17 | ○–◎ | ◎: Excellent see-through preventive feel, also excellent bulky feel |
| 18 | ○–◎ | ◎: Bulkiness, extremely soft, antidrape stiffness |
| 19 | ○–◎ | ◎: Bulkiness, extremely soft, antidrape stiffness |
| 20 | ○–◎ | ◎: Bulkiness, extremely soft, antidrape stiffness |
| 21 | ○–◎ | ◎: Bulkiness, extremely soft, antidrape stiffness |
| 22 | ○–◎ | ◎: Bulkiness, extremely soft, antidrape stiffness |

PBT: Polybutylene terephthalate, SPI1.7CoPET: 5-sodium sulfoisophthalic acid 1.7 mol % copolymerized polyethylene terephthalate, PET: polyethylene terephthalate, PLLA: polylactic acid, PPT: polypropylene terephthalate, PP: polypropylene

[1)]Compound formed by adding 2 mol ethylene oxide to sorbitol

[2)]Polyglycerine laurate,

[3)]Ethylene oxide/propylene oxide random copolymer

| EQUILIBRIUM WATER CONTENT (%) | |
|---|---|
| IPA6coPET | 0.4 |
| PBT | 0.4 |
| SIP1.7CoPET | 0.45 |
| PET | 0.4 |
| PLLA | 0.4 |
| PPT | 0.4 |
| PP | 0.05 |

From the result of Table 1, the woven fabrics comprising porous hollow fibers defined in this invention were excellent in the lightness and having excellent hand of soft and bulky feels.

EXAMPLES 2–5

Fiber formation, fabric preparation and evaluation were conducted in the same manner as in Example 1 except for changing the number and the conjugate ratio of islands and under the conditions shown in Table 1. All of fabrics were excellent in lightness and had excellent hand with soft and bulky feels.

EXAMPLES 6–9

Fiber formation, fabric preparation and evaluation were conducted in the same manner as in Example 1 except for changing the modifying species, modification degree and the number of islands for the island component as shown in Table 1. All of fabrics were excellent in lightness and had excellent hand with soft and bulky feels.

EXAMPLES 10–17

Fiber formation, fabric preparation and evaluation were conducted in the same manner as in Example 1 except for changing the type for the sea component polymer, fiber cross section, number of islands and composite ratio as shown in Table 1. All of fabrics were excellent in lightness and had excellent hand with soft and bulky feels.

EXAMPLE 18

A plasticizer-added modified PVA was prepared by adding 10 mass % of a compound comprising 1 mol of sorbitol and 2 mol of ethylene oxide added thereto to the modified PVA used in Example 1 by using a twin shaft extruder. The plasticizer-added modified PVA had an apparent melt-viscosity of 130 Pa.s at 240° C. and at a shear rate of 1000 $sec^{-1}$ and the viscosity reducing effect was 70 Pa.s. Then, fibers were formed as in Example 1 except for using the plasticizer-added modified PVA and changing the number of islands, and various types of evaluation were conducted as fabrics.

The woven fabrics comprising the porous hollow fibers of this invention were excellent in lightness and see-through preventive performance and had excellent hand with soft and bulky feels.

EXAMPLES 19, 20

Fibers were formed as in Example 1 except for changing the type of the modified PVA and the plasticizer and the number of islands as shown in Table 1 and various types of evaluation were conducted for woven fabrics. All of the fabrics were excellent in lightness and see-through preventive performance and had bulkiness and extremely soft hand.

EXAMPLES 21, 22

Fibers were formed as in Example 1 except for the shape of the fiber cross section and the number of islands and various kinds of evaluations were conducted as woven fabrics shown in Table 1. All of the fabrics were excellent in lightness and see-through preventive performance, bulkiness hand and had extremely soft hand.

EXAMPLE 23

Polyethylene terephthalate (hereinafter simply referred to as PET) of an intrinsic viscosity of 0.68 (in o-chlorophenol concentration, 30° C.) containing 2.5 mass % of silica with a primary average grain size of 0.04 $\mu$m was used as the sea component and the modified PVA used in Example 1 was used as the island composition. They were melt-extruded separately and individually and melt-spun at a highest zone temperature of the modified PVA of 230° C., using composite spinning parts so as to suppress the melt-stagnation of the modified PVA as less as possible and under the conditions for the number of island of 36 and the conjugate ratio: sea/island=60/40 through a circular hole nozzle with a nozzle diameter of 0.30 mm $\phi$ and 24 holes at a spinning temperature of 275° C.

A horizontal blowing type cooling air blowing device of 1.0 m length was installed just below the spinneret, and the conjugate fiber spun from the spinneret was directly introduced into the cooling air blowing device and cooling air adjusted to a temperature of 25° C. and a relative humidity of 65 RH % was blown to the spun fiber at a rate of 0.5 m/sec to cool the fiber down to 50° C. or lower (temperature of the fiber at the exit of the cooling air blowing device=40° C.).

After introducing the conjugate fiber cooled to 50° C. or lower into a tube heater of 1.0 m length and 30 mm inner diameter located just below the spinneret (inner wall temperature: 160° C.) being spaced by 1.1 m and drawn in the tube heater, an oily agent was applied to the fiber outputted from the tube heater by a guide oiling system and, successively, the fiber was taken up by way of a pair of take-up rollers at a take-up speed of 3500 m/min, to produce of 84 dtex 24 filament drawn conjugate fibers.

The spinnability of the conjugate fibers upon applying the spinning and drawing steps, as well as the evenness of the finally obtained fibers (Usters yarn evenness: U %) was 0.75 and the number of fluffing occurred was 0.1 $N/10^6m$.

Then, using the conjugate fiber as the wefts and warps to prepare plain woven fabrics with 100 removal ratio for PVA in the same manner as in Example 1. The woven fabrics had bulkiness and had hand with soft feel and soft with no unevenness of yarn.

EXAMPLE 24

Fiber forming, woven fabric preparation and evaluation were conducted in the same manner as in Example 23 except for changing the silica content to 5 mass %. The thus obtained conjugate fibers had U % of 0.88 and the number of fluffing occurred was 0.3 $N/10^6m$.

Then, plain woven fabrics with the PVA removal rate of 100 were prepared in the same manner as in Example 23 using the conjugate fibers for the wefts and warps. The woven fabrics had bulkiness and hand of soft feel and with no unevenness of yarns.

EXAMPLE 25

Fiber forming, woven fabric preparation and evaluation were conducted in the same manner as, those in Example 23 except for changing average grain size of silica to 0.3 hum and the silica content to 1 mass %. The thus obtained conjugate fibers had U % of 0.83 and the number of fluffing occurred was 0.1 N/$10^6$m.

Then, plain woven fabrics with the PVA removal rate of 100 were prepared in the same manner as in Example 23 using the conjugate fibers for the wefts and warps. The woven fabrics had bulkiness and hand with soft feel and. with no unevenness of yarn.

EXAMPLE 26

Formation of fibers woven fabric preparation and evaluation were conducted in the same manner as in Example 23 except for using 4 mol isophthalic acid modified polyethylene terephthalate containing 0.045 mass % of titanium oxide ({η}=0.68, simply referred to as IPA4coPET) and setting the number of the island component as 12. The formed conjugate fiber, had U % of 0.92 and the number of fluff occurred of 0.1 N/$10^6$m.

Then, plain woven fabrics with PVA removal of ratio of 100 were prepared in the same manner as in Example 23 using the conjugate fibers as the wefts and warps. The woven fabrics had bulkiness and hand with soft feel and with no unevenness of yarn.

Obviously, numerous modifications and variations of the present invention are possible in light of the above teachings. It is therefore to be understood that within the scope of the appended claims, the invention may be practiced otherwise than as specifically described herein.

This application is based on Japanese patent applications JP 73755/2000, filed Mar. 16, 2000, and JP 355502/2000, filed Nov. 22, 2000, the entire contents of each of which are hereby incorporated by reference, the same as if set forth at length.

What is claimed is:

1. A hollow fiber, comprising:

at least one thermoplastic polymer with an equilibrium water content of 2% or less;

wherein the number of hollow portions ($\alpha_1$) and a hollow ratio ($\alpha_2$) in said fiber satisfy the following equations:

$$\alpha_1 \geqq 7$$

$$2 \leqq \alpha_2 \leqq 65$$

$$0.14 \leqq (\alpha_1 \times \alpha_2)/100 \leqq 250.$$

2. The hollow fiber according to claim 1, wherein the thermoplastic polymer comprises a polyolefin or polyester.

3. The hollow fiber according to claim 1, wherein the thermoplastic polymer is a homopolymer or copolymer of a polymer selected from the group consisting of polyethylene, polypropylene, polymethylpentene, polyethyelene terephthalate, polybutylene terephthalate, polyhexamethylene terephthalate, polypropylene terephthalate, polylactic acid, polyphenylene sulfide, polyallylate, polycarbonate, polymethyl methacrylate, polyvinyl chloride, polyvinylidene chloride, polyurethane, polybutadiene, hydrogenated polybutadiene, polyisoprene, hydrogenated polyisoprene, a copolymer of an aromatic vinyl monomer and a diene monomer, hydrogenation product of a copolymer of an aromatic vinyl monomer and a diene monomer, and combinations thereof.

4. The hollow fiber according to claim 1, wherein the fiber is a continuous fiber.

5. The hollow fiber according to claim 1, wherein the thermoplastic polymer is a polyester having an intrinsic viscosity {η} of 0.52 to 0.85.

6. The hollow fiber according to claim 1, wherein the thermoplastic polymer comprises at least one inorganic particle selected from the group consisting of particles of silica, alumina, calcium carbonate, titanium oxide, barium sulfate, and combinations thereof.

7. The hollow fiber according to claim 1, wherein the thermoplastic polymer comprises at least one inorganic particle having a primary average particle size of 0.01 to 5.0 μm.

8. The hollow fiber according to claim 1, wherein the thermoplastic polymer comprises inorganic particles in an amount of 0.05 to 10.0 mass %.

9. The hollow fiber according to claim 1, wherein the thermoplastic polymer is a polyester having an intrinsic viscosity {η} of 0.52 to 0.85 and comprises inorganic particles, wherein the primary average particle size (μm) of the inorganic particles and the content (mass %) of the inorganic particles in the polyester satisfy the following relation:

$$0.01 \leqq \text{primary average particle size } (\mu m) \leqq 5.0$$

$$0.05 \leqq \text{fine inorganic particles content (mass \%)} \leqq 10.0$$

$$0.01 \leqq X \leqq 3.0$$

where X=primary average particle size (μm)×inorganic particle content (mass %).

10. The hollow fiber according to claim 1, wherein the fiber has a cross-sectional shape selected from the group consisting of flattened, elliptic, polygonal, trigonal, octagonal, T-shape, multilobal, trilobal, tetralobal, pentalobal, hexalobal, heptalobal and octalobal.

11. A fiber structure, comprising the hollow fiber as claimed in claim 1.

12. An article selected from the group consisting of multi-filament yarn, spun yarn, woven fabric, knitted fabric, non-woven fabric, paper, artificial leather, fiberfill, textured yarn, blended filament yarn, blended spun yarn, twisted yarn, entangled yarn, crimped yarn, union woven fabric, union knitted fabric, fiber laminate, natural fiber laminate, semi-synthetic fiber laminate, synthetic fiber laminate, clothing, living material, industrial material, medical articles, and combinations thereof, comprising the hollow fiber as claimed in claim 1.

* * * * *